US006605891B1

(12) United States Patent
Nose

(10) Patent No.: US 6,605,891 B1
(45) Date of Patent: Aug. 12, 2003

(54) CATHODE RAY TUBE

(75) Inventor: Hisashi Nose, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/504,078

(22) Filed: Feb. 15, 2000

(30) Foreign Application Priority Data

Feb. 24, 1999 (JP) ..... 11-046407

(51) Int. Cl.[7] ..... H01J 29/76
(52) U.S. Cl. ..... 313/477 R; 220/2.1 A
(58) Field of Search ..... 313/477 R; 220/2.1 A

(56) References Cited

U.S. PATENT DOCUMENTS 5,917,275 A * 6/1999 Uchida et al. ..... 313/414
5,929,559 A * 7/1999 Sano et al. ..... 313/477 R
6,281,623 B1 * 8/2001 Suzuki et al. ..... 313/440

* cited by examiner

*Primary Examiner*—Sandra O'Shea
*Assistant Examiner*—Anabel Ton
(74) *Attorney, Agent, or Firm*—Antonelli, Terry, Stout & Kraus, LLP

(57) ABSTRACT

In a cathode ray tube of the present invention, the shape 20 of an outer wall opening and the shape 21 of an inner wall opening in a direction perpendicular to a tube axis within a range which extends 35 mm to the panel portion side and 20 mm to the neck portion side from a reference line set in a deflection yoke mounting region of a funnel portion are respectively formed in an approximately rectangular shape and an approximately pin-cushion shape, and the shape 21 of the inner wall opening of deflection yoke mounting region of the funnel portion in a direction perpendicular to a tube axis direction has a radius of curvature Rc at respective corners, and the difference between a first straight line 22V and 22H which connects neighboring bottom portions of the corners and a second straight line 23V and 23H which is in contact with a central point of the inner wall between the neighboring corner portions and is disposed parallel to the first straight line is set to 2.0 mm at maximum provided that the direction toward the tube axis is taken as +.

19 Claims, 5 Drawing Sheets

(a−a')

(b−b')

(c−c')

CATHODE RAY TUBE

FIELD OF THE INVENTION

The present invention relates to a color cathode ray tube, and more particularly to a color cathode ray tube capable of facilitating the reliable internal graphite coating operation and reducing the power consumption of a deflection yoke.

BACKGROUND OF THE INVENTION

In general, a cathode ray tube which is employed as an image display device is constituted by a vacuum envelope which is formed by connecting a panel portion which forms a screen by coating a phosphor on an inner surface thereof, a neck portion which accommodates an electron gun, and a funnel portion in a funnel shape which gradually reduces the diameter thereof in the direction from the panel portion to the neck portion.

In a color cathode ray tube, a color screen to which a plurality (usually three colors) of phosphors are coated is provided to an inner surface of a panel portion, a shadow mask which works as a color selection electrode is arranged adjacent to the screen, and an inline-type electron gun which irradiates three electron beams is accommodated in a neck portion.

The color cathode ray tube includes a stem at the end of the neck portion, wherein the stem supports the accommodated electron gun and allows stem pins which supply a given voltage or given signals to the electron gun to pass therethrough for mounting thereof to be mounted in an annular manner thus sealing the neck portion. A deflection yoke which reproduces an image on the screen by deflecting the electron beams in both horizontal and vertical directions is mounted on the outer surface of the funnel portion.

A color display tube (CDT) used as a monitor device of an information processing terminal is used with a higher deflection frequency than a conventional cathode ray tube for television and hence, the deflection power is increased.

In such a cathode ray tube, as a means for reducing the power consumed by the deflection yoke, the outer diameter size of a portion on which the deflection yoke of the funnel is mounted (deflection yoke mounting region) may be made small so as to make the deflection yoke approach to the electron beams thus efficiently applying the deflection magnetic field to the electron beams.

However, in case the outer diameter of the deflection yoke mounting region is simply made small, a portion of the funnel portion connected to the neck portion (smaller diameter portion of the funnel portion) becomes narrow and hence, at the time that the electron beams take the maximum deflection angle, the electron beams impinge on the inner wall of the funnel portion thus giving rise to a region on the phosphor screen where the electron beams do not reach (non-scanned portion).

In view of such a fact, Japanese Laid-Open Patent Publication Hei 10-144238/1998 discloses a cathode ray tube which forms an outer wall of a deflection yoke mounting region of the funnel portion in a pyramidal shape so as to narrow the distance between the deflection yoke and the electron beams and to avoid the occurrence of a non-scanned portion. However, in case the outer wall of the deflection yoke mounting region is formed in the pyramidal shape, the mechanical strength of the vacuum envelope is weakened and hence, a possibility that a so-called implosion occurs is increased. In the above-mentioned Japanese Laid-open Publication Hei 10-144238/1998, to prevent the occurrence of the implosion, a reinforcing member is mounted on a connecting portion between the pyramidal-shaped deflection yoke mounting region and the panel portion. The cathode ray tube disclosed in this publication has a cross section of an outer wall thereof in a direction perpendicular to the tube axis of the deflection yoke mounting region formed in a rectangular shape and a cross section of an inner wall thereof also formed in a similar rectangular shape.

Further, Japanese Utility model Publication Sho 44-29152/1969 discloses a cathode ray tube in which to eliminate a non-scanned portion on a connecting region between the funnel portion and the neck portion (narrow-diameter portion of the funnel portion) which is caused by the enlargement of the deflection angle of the cathode ray tube, and to obviate the implosion, the opening shape of the inner wall (cross section of inner wall in a direction perpendicular to the tube axis) of the portion where the diameter of the funnel portion is narrowed is formed such that bulges which protrude inwardly are formed (in a so-called pin-cushion shape) on given portions of all of or two parallel sides out of four sides which form the profile line, and the corners are rounded.

In this type of cathode ray tube, a so-called internal graphite film is coated on an approximately entire surface of of the inner wall of the funnel portion and the neck portion connected to the funnel portion. This internal graphite film has a function of supplying a high voltage applied to an anode button which is mounted by passing through the large-diameter wall surface of the funnel from the front to the back thereof to an anode electrode of the electron gun.

This internal graphite film is formed before the panel portion is connected to the funnel portion such that a coating liquid which disperses graphite particles in a solvent is coated to the inner surface of the funnel portion and then is dried. That is, the funnel is rotated in a condition that the funnel is vertically installed with a side of a large diameter to which the panel portion is connected directed upwardly and the neck portion side directed downwardly and the internal graphite is coated by means of an automatic brush coating machine.

In this internal graphite coating operation, the inner wall of the large-diameter portion of the funnel portion is formed of a substantially flat wall and hence, problems such as the uneven coating or the liquid well do not occur. In the deflection yoke mounting region, however, the cross section of the inner wall is narrow and hence, problems such as the uneven coating of the graphite coating liquid, the liquid well, or the sagging of liquid in the tubular inside of the neck portion are liable to occur.

Particularly, in a case as disclosed in Japanese Utility model Publication Sho 44-29152/1969 where the opening shape of the inner wall of the deflection yoke mounting region is formed such that given portions of all or opposing two sides out of four sides which constitute the profile of the opening are provided with bulges which protrude inwardly to form a pin-cushion shape, a brush cannot smoothly come into contact with the inner wall surface and hence, the uneven coating occurs at four corners or the coating liquid well occurs thus deteriorating the reliability of the cathode ray tube.

Although the above-mentioned prior art discloses the prevention of the occurrence of the non-scanned portion due to the increase of the deflection angle and the enhancement of the mechanical strength of the vacuum envelope, the prior art neither discloses nor suggests the problems which occur in the internal graphite film coating operation.

SUMMARY OF THE INVENTION

The color cathode ray tube of the present invention includes a vacuum envelope comprised of a panel portion having an approximately rectangular shape which forms a phosphor film on an inner surface thereof, a neck portion which accommodates an electron gun, and a funnel portion which connects the panel portion and the neck portion, wherein an outer wall cross section of a deflection yoke mounting region of the funnel portion in a direction perpendicular to the tube axis is formed in an approximately rectangular shape, and an inner wall cross section is formed in an approximately pin-cushion shape, which has curvatures for forming recesses at corner portions. The respective corner portions have inwardly indented curvatures, and the difference between a first straight line which connects neighboring bottom portions of said the corners and a second straight line which is in contact with a central point of the inner wall between the neighboring corner portions and is disposed parallel to the first straight line is set to 2.0 mm at maximum and preferably not more than 1.0 mm provided that the direction toward the tube axis is taken as +, and the outer diameter of the neck portion is set to not more than 25.3 mm.

Further, in the cathode ray tube of the present invention, the shapes of the outer wall cross sections taken in a direction perpendicular to the tube axis within a range covering 35 mm toward the panel portion side and 20 mm toward the neck portion side from a reference line set in the deflection yoke mounting region of the funnel portion is formed in a rectangular shape and the inner wall cross sections is provided with pin-cushion shape portions which have curvatures to form recesses at corners of the inner wall.

The cathode ray tube of the present invention includes a vacuum envelope which is comprised of an approximately rectangular shape which forms a three-color phosphor film on an inner surface thereof, a neck portion which accommodates an inline type electron gun and a funnel portion which connects the panel portion and the neck portion. The cathode ray tube includes a deflection yoke mounting region at a transition region between the funnel portion and the neck portion. At a reference line set in the deflection yoke mounting region of the funnel portion, the shape of an outer wall opening and the shape of an inner wall opening in a direction perpendicular to a tube axis are respectively formed in an approximately rectangular shape and in an approximately barrel shape, and in case a radius of curvature of the outer wall cross section of the deflection yoke mounting region is set to R1 (mm) and a radius of curvature of the inner wall cross section of the deflection yoke mounting region is set to R2 (mm), the relationship between the radii R1 and R2 is determined such that $R1 \geqq 100$ mm and $R2 \geqq R1$, and the outer diameter of the neck portion is not more than 25.3 mm.

Here, the reference line set in the deflection yoke mounting region of the funnel portion is positioned at the central portion of the deflection yoke mounting region in the tube axis direction and this position is defined by EIAJ ED-2134.

Due to the above-mentioned constitutions, the internal graphite film coating operation in the deflection yoke mounting region can be carried out smoothly and the formation of the irregular film thickness due to the uneven coating or the liquid well, or the sagging of coating liquid in the tubular inside of the neck portion can be avoided and hence, a cathode ray tube which can obtain the high reliability and can reduce the deflection power is realized.

BRIEF EXPLANATION OF THE DRAWINGS

FIG. 6(*b*) is an explanatory view of the inner wall in the deflection yoke mounting region shown in FIG. 5.

DESCRIPTION OF PREFERRED EMBODIMENT

Embodiments of the present invention are hereinafter explained in conjunction with attached drawings.

Figure 1:
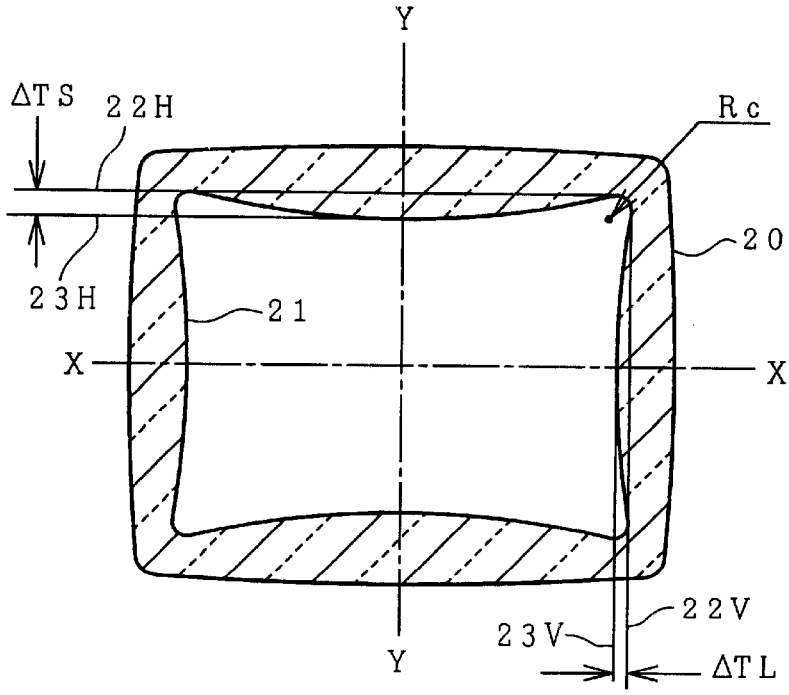
FIG. 1 is a cross-sectional view of a cathode ray tube of an embodiment of the present invention at a reference line in a deflection yoke mounting region.

FIG. 1 is a cross-sectional view of a color cathode ray tube taken along a reference line of a deflection yoke mounting region. In FIG. 1, numeral 20 indicates an outer wall of the deflection yoke mounting region (a profile line of the outer wall of the pyramidal portion on a cross section in a direction perpendicular to the tube axis) and numeral 21 indicates an inner wall (a profile line of the inner wall of the same pyramidal portion on the same cross section). The cross sectional shape of the cathode ray tube of this embodiment is approximately rectangular with respect to both of the outer wall and the inner wall thereof, wherein the outer wall 20 is formed to have a shape in which the central portions thereof are slightly bulged toward the outside relative to the tube axis (the shape in which four sides constituting the profile are protruded outwardly: this shape is referred to as a barrel shape), while the inner wall 21 is formed to have a so-called pin cushion shape which has recesses having a radius of curvature Rc at respective corners (four corner portions) (the shape in which the four sides constituting the profile are protruded inwardly).

In the cathode ray tube of this embodiment, the difference $\Delta TL$ between a straight line (vertical direction: first line) 22V which is disposed parallel to a short axis Y-Y which connects neighboring bottom portions of the corner portions of the inner wall and a straight line 23V which is in contact with an intermediate point of the inner wall shape 21 and is disposed parallel to the short axis Y-Y and the distance $\Delta TS$ between a straight line (horizontal direction: second line) 22H which is disposed parallel to a long axis X-X and a straight line 23H which is in contact with an intermediate point of the inner wall shape 21 and is disposed parallel to the long axis X-X are both set to not more than 2.0 mm, and preferably not more than 1.0 mm in the deflection yoke mounting region which extends 35 mm at maximum toward the panel portion side from the reference line and 20 mm at maximum toward the neck portion side from the reference line provided that the direction toward the tube axis is taken as +.

The outer wall shape 20 of the deflection yoke mounting region is not limited to an approximately barrel shape (a protruded surface) which is bulged outwardly both at the short axis (vertical direction axis) side and the long axis (horizontal direction axis) side, and four sides which constitute the plane, that is, the profile of the cross section or one pair out of two pairs sides may be formed by straight lines.

Figure 2:
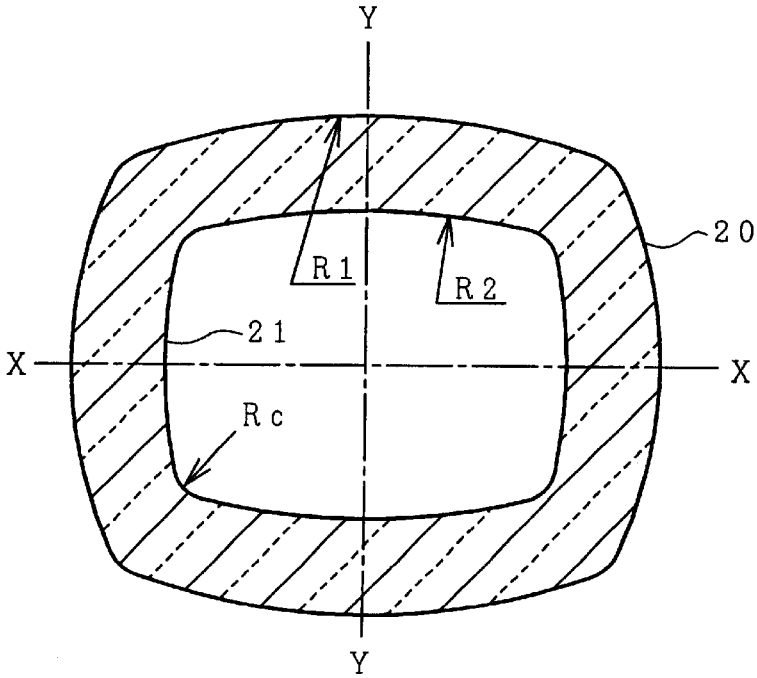
FIG. 2 is a cross-sectional view of a cathode ray tube of another embodiment of the present invention at a reference line in a deflection yoke mounting region.

FIG. 2 is a cross-sectional view of a cathode ray tube of another embodiment of the present invention along the reference line of the deflection yoke mounting region. The profile line of the outer wall shape 20 and the profile line of the inner wall shape 21 are both formed in a barrel shape. Here, provided that a radius of curvature of the profile line of the outer wall shape 20 is set to R1 (mm) and a radius of curvature of the profile line of the inner wall shape 21 is set to R2 (mm), the relationship that R1≧100 mm and R1≧R2 are established. By making the radii R1 and R2 have such a relationship, the sensitivity of the deflection magnetic field generated by the deflection yoke against electron beams is enhanced and the deflection power can be reduced. It is enough so long as the above-mentioned relationship between the radius R1 of curvature of the profile line of the outer wall shape 20 and the radius R2 of the curvature of the profile line of the inner wall shape 21 is determined at least on the reference line of the deflection yoke mounting region. By making the inner and outer wall shapes of the deflection yoke mounting region of the cathode ray tube have shapes shown in FIG. 1 and FIG. 2, the internal graphite film coating operation can be facilitated and a uniform coated film free from the uneven coating or the sagging of coating liquid in the inside of the tube can be formed and hence, the lowering of the function of the internal graphite film or the peeling-off caused by the insuffciently coated film can be obviated, thus the cathode ray tube having the high reliability and low power consumption can be obtained.

Figure 3:
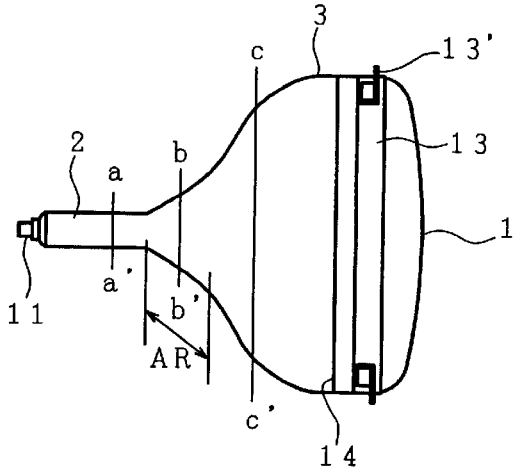
FIG. 3 is a side view explaining an example of the contour of an embodiment of a cathode ray tube of the present invention.

FIG. 3 is a side view showing an example of the contour of the cathode ray tube of this invention. The cathode ray tube of this embodiment is a color cathode ray tube which accommodates an inline type electron gun in the neck portion. In this color cathode ray tube, the panel portion 1 and the funnel portion 3 are adhered to each other by means of a seal line 14. An explosion-proof band 13 is fastened in the vicinity of the panel portion side of this seal line 14. Numeral 13' indicates a mounting bracket.

A stem 11 is mounted on an terminal end of the neck portion 2 of the cathode ray tube and the deflection yoke mounting region AR which mounts a deflection yoke thereon is formed at a transition portion of the funnel portion 3 with the neck portion 2. The deflection yoke (not shown in the drawing) is mounted on this deflection yoke mounting region AR. The profiles of the cross sections of the outer wall and the inner wall in a direction perpendicular to the tube axis in the deflection yoke mounting region AR are shaped as has been explained in conjunction with FIG. 1 and FIG. 2.

The manner for mounting the deflection yoke may adopt a method which slidably fits the deflection yoke around the neck portion 2 from the stem 11 side or a method which uses the deflection yoke having a two-split structure and combines them around the deflection yoke mounting region AR.

Figure 4:
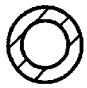
FIG. 4(*a*) to FIG. 4(*c*) are explanatory views of the shapes of cross sections of essential portions of the color cathode ray tube shown in FIG. 3, wherein FIG. 4(*a*) shows the cross section taken along a line a–a' of FIG. 3, FIG. 4(*b*) shows the cross section taken along a line b–b' (cross section at the reference line R/L) and FIG. 4(*c*) shows the cross section taken along a line c–c' of FIG. 3.
Figure 4:
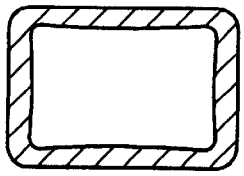
Figure 4:
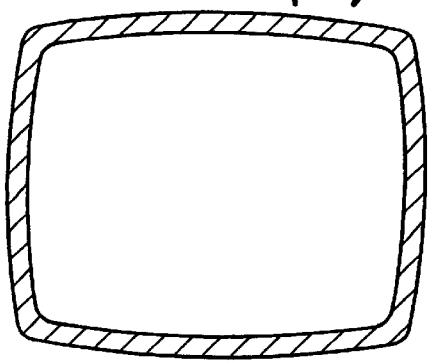

FIG. 4(*a*) to FIG. 4(*c*) are explanatory views showing the cross-sectional shapes of the essential portions of the color cathode ray tube shown in FIG. 3, wherein FIG. 4(*a*) shows a cross section taken along a line a–a' of FIG. 3, FIG. 4(*b*) shows a cross section taken along a line b–b' of FIG. 3 (cross section at the reference line R/L), and FIG. 4(*c*) shows a cross section taken along a line c–c' of FIG. 3.

The profile line of the outer wall shape and the profile line of the inner wall shape at the reference line of the deflection yoke mounting region AR correspond to those profiles which have been explained in conjunction with FIG. 1. In case of the cathode ray tube of the embodiment shown in FIG. 2, the shape of the cross section taken along the line b–b' of FIG. 3 (cross section at the reference line R/L) adopts the shape similar to the cross section shown in FIG. 2.

The cross-sectional shape of an electron beam accommodating portion of the neck portion 2 of the cathode ray tube of the embodiment of the present invention is circular as shown in FIG. 4(*a*) and the cross-sectional shape of deflecting yoke mounting region AR portion of the funnel portion 3 includes the pyramidal inner and outer walls (the cross section being an approximately laterally elongated rectangular shape) as shown in FIG. 4(*b*). The cross-sectional shape from the deflection yoke mounting region AR to the panel 1 side is similar to the approximately screen shape shown in FIG. 4(*c*).

Figure 5:
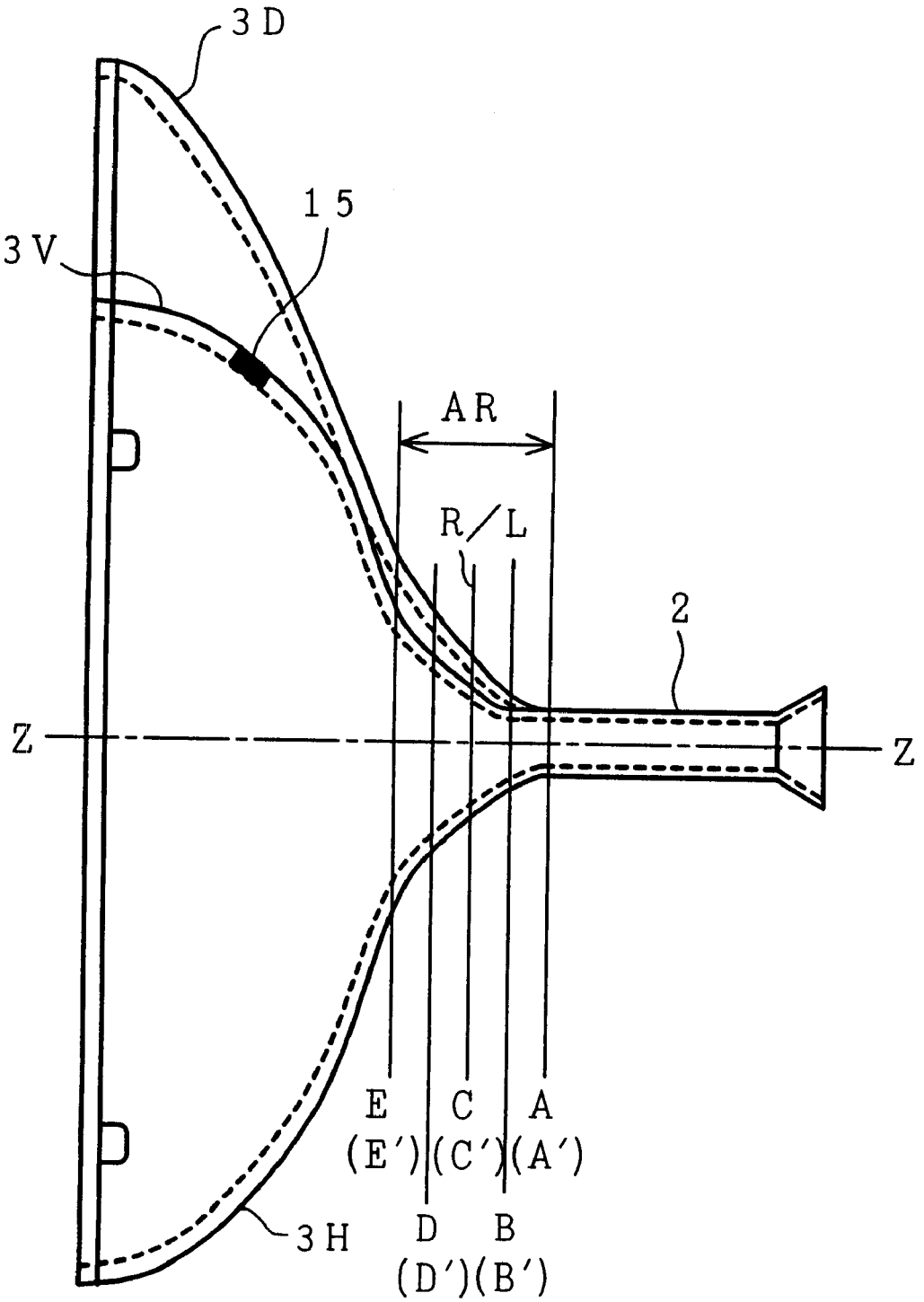
FIG. 5 is a side view schematically explaining the contour of the funnel portion of the cathode ray tube of the embodiment of the present invention.
Figure 6:
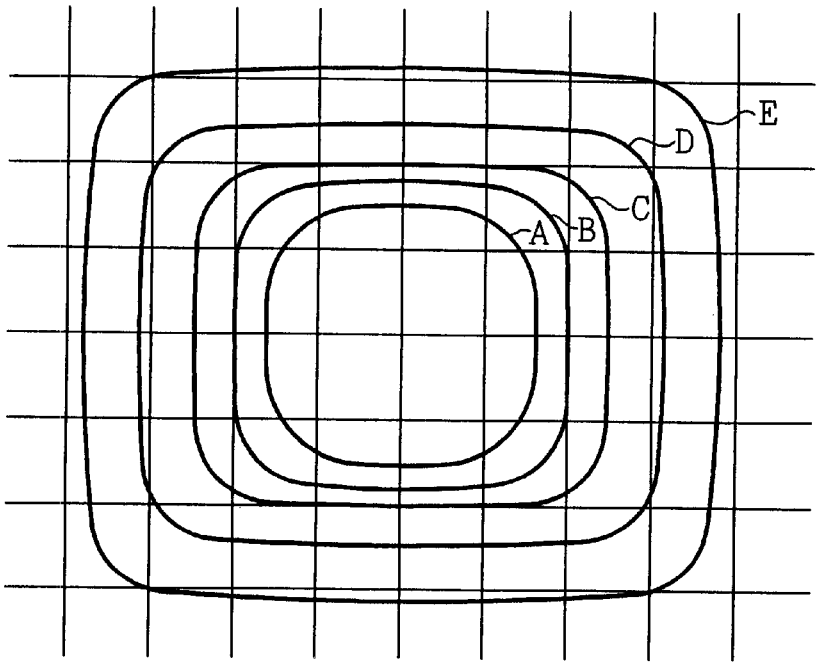
FIG. 6(*a*) is an explanatory view showing the cross-sectional shape of the outer wall in the deflection yoke mounting region shown in FIG. 5.
Figure 6:
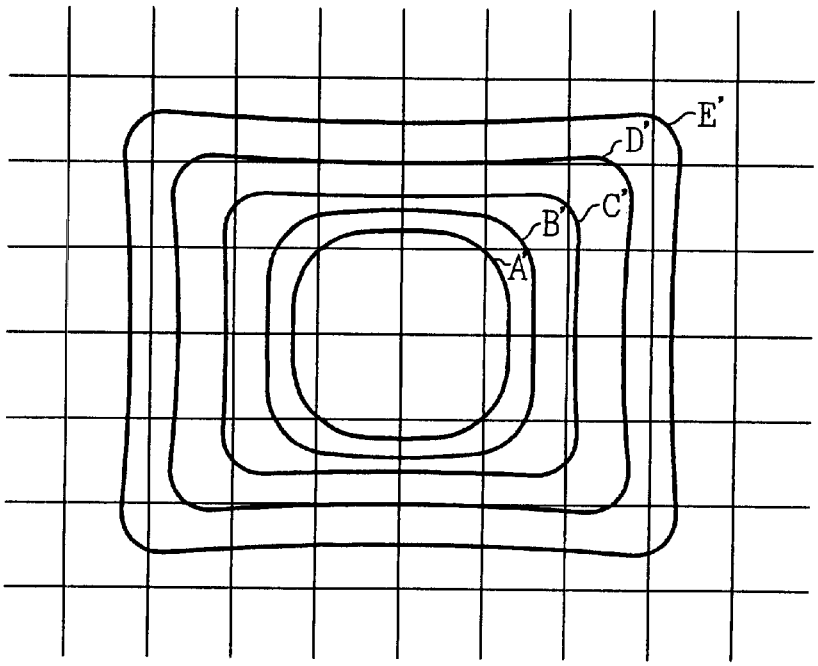

FIG. 5 is a side view schematically showing the contour of a funnel portion of a color cathode ray tube of the embodiment of the present invention. FIG. 6(*a*) is an explanatory view showing the cross-sectional shape of the outer wall at the deflection yoke mounting region shown in FIG. 5, while FIG. 6(*b*) is an explanatory view showing the cross-sectional shape of the inner wall at the deflection yoke mounting region shown in FIG. 5. In FIG. 6(*a*) and FIG. 6(*b*), longitudinal and lateral straight lines are reference lines for clarifying the bulges of the cross-sectional shapes.

In FIG. 5, numeral 2 indicates a neck portion, numeral 3V indicates a funnel outer wall in a short axis direction, numeral 3H indicates a funnel outer wall in a long axis direction, numeral 3D indicates a funnel outer wall in a diagonal direction, and numeral 15 indicates an anode button. Further, in FIG. 5, symbol Z-Z indicates a tube axis, symbol AR indicates a deflection yoke mounting region, symbol R/L indicates a reference line, symbols A(A'), B(B'), C(C'), D(D') and E(E') indicate cutting lines at a plurality of positions along the tube axis in the deflection yoke mounting region, wherein A, B, C, D, E show the positions of cutting lines of the outer wall and A', B', C', D' and E' show the positions of cutting lines of the inner wall. The cutting line C(C') agrees with the reference line R/L. The range of the deflection yoke mounting region AR covers a range which extends 35 mm toward the panel portion side (in a left direction along the tube axis Z-Z in FIG. 5) from the reference line R/L (cutting line C(C')) and a range which extends 20 mm toward the neck portion side (in a right direction along the tube axis Z-Z in FIG. 5) from the reference line R/L.

FIG. 6(*a*) shows the outer wall shapes (profile line shapes) cut by cutting lines A, B, C, D, E and FIG. 6(*b*) shows inner wall shapes (profile line shapes) cut, by cutting lines A', B', C', D' and E'. As shown in FIG. 6(*a*), in the color cathode ray tube of this embodiment, the outer wall shape of the deflection yoke mounting region, that is, the shape of the outer diameter line (profile line) on the cross section in a direction perpendicular to the tube axis is protruded outwardly substantially in the entire region. Further, in the cathode ray tube of this embodiment, as shown in FIG. 6(*b*), the inner wall shape, that is, the inner wall shape as seen on a cross section in a direction perpendicular to the tube axis side (the profile line) has a shape which protrudes toward the tube axis (that is, formed in a pin cushion shape) when the cutting line exceeds the cutting line C', that is, the reference line and extends in a panel portion direction. The inner wall shape, however, is not limited to this inner wall shape and the inner wall shape has a shape which protrudes toward the tube axis side (that is, a pin-cushion shape) even when the cutting line extends in a neck portion direction from the reference line (cutting line C').

Due to the constitutions of the embodiments which are explained heretofore, the coating operation of the internal graphite film in the deflection yoke mounting region becomes smooth and the formation of the irregular film thickness of the internal graphite film caused by the uneven coating or the liquid well can be avoided thus obtaining the highly reliable cathode ray tube. Further, in the cathode ray tube of the present invention, the shape of the deflection yoke mounting region has a pyramidal shape and hence, the deflection yoke can be disposed closer to the electron beams compared to a cathode ray tube with a deflection yoke mounting region having a circular cross section so that the deflection efficiency is enhanced and the deflection power can be reduced.

In another embodiment of the present invention which is explained in conjunction with FIG. 2 previously, the inner wall shape adopts the shape similar to the shape shown in FIG. 6(*a*), that is, the barrel shape where four sides of the inner wall are protruded in a direction away from the tube axis. It is enough that the inner wall shape adopts the barrel shape when it is viewed at least along the reference line.

That is, according to this embodiment, along with the reduction of the power consumption of the deflection yoke, the coating operation of the internal graphite to be coated can be carried out easily and assuredly, and the internal graphite coating liquid does not concentrate at corner portions and is supplied to the entire inner surface of the funnel portion before being dried on the inner wall of the deflection yoke mounting region of the funnel portion and hence, the peeling-off of the graphite film due to the uneven film thickness or the sagging of the undried graphite coating liquid in the tubular inside of the neck portion can be eliminated.

Figure 7:
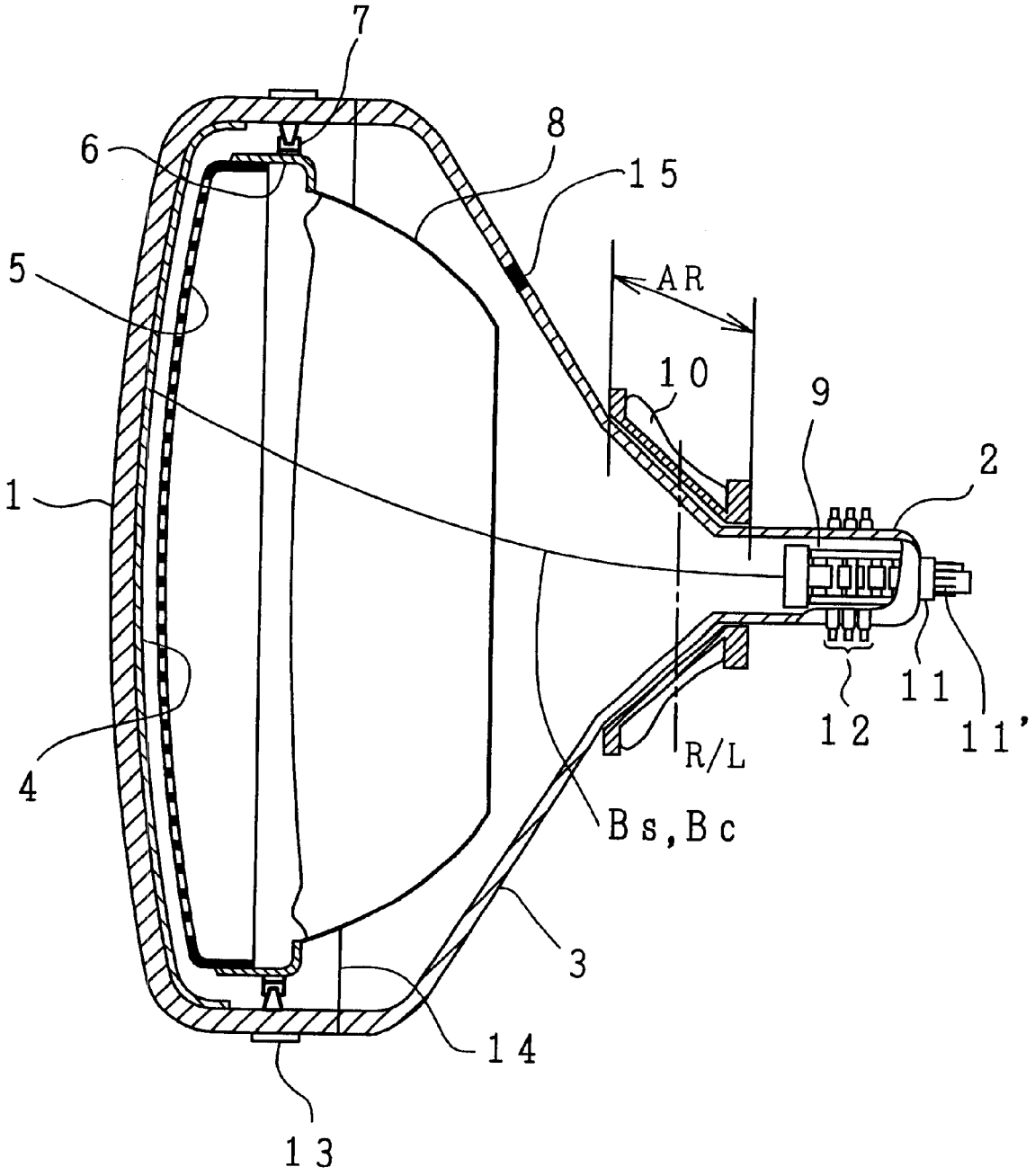
FIG. 7 is a cross-sectional view explaining an example of the entire structure of the cathode ray tube of the embodiment of the present invention.

FIG. 7 is a cross-sectional view explaining an example of an overall structure of the color cathode ray tube to which the present invention is applied. In this color cathode ray tube, a vacuum envelope is constituted by a panel portion 1 which forms a screen by coating a phosphor 4 made of three colors, red, green and blue on the inner surface, a neck portion 2 which accommodates an electron gun 9, and a funnel portion 3 which connects the panel portion 1 and the neck portion 2. A shadow mask 5 which constitutes a color selection electrode is installed adjacent to the phosphor 4 of the panel portion 1. This shadow mask 5 is welded to a mask frame 6 and the mask frame 6 is suspended and supported by a suspension mechanism 7 mounted on an inner wall of a skirt of the panel portion 1. An internal magnetic shield 8 is fixedly secured to the mask frame 6 so as to shield the electron beams from the external magnetism such as the earth magnetism. The deflection yoke mounting region AR which is positioned at the transition portion between the funnel portion 3 and the neck portion 2 has the inner and outer wall surface shapes which have been explained in respective embodiments. On this deflection yoke mounting region AR, a deflection yoke 10 is mounted using the reference line R/L as the reference position. To the end portion of the neck portion 2, a stem 11 which allows stem pins 111 pass therethrough for mounting thereof is fixedly secured for supplying a given voltage or given signals to the electron gun 9. An external magnetism device 12 which adjusts the color purity and the static convergence is mounted on the outer periphery of the neck portion 2. Numeral 13 indicates an explosion-proof band and numeral 14 indicates a connecting line of the panel portion 1 and the funnel portion 3.

Three electron beams (center beam Bc, side beam Bs×2) which are modulated by image signals supplied by way of the stem pins 111 and irradiated in line from the electron gun 9, and are deflected in two dimension in the horizontal and vertical deflection magnetic fields generated by the deflection yoke 10, and are subjected to the color selection as they pass through a large number of apertures or the blind-like electron beam transmission apertures and scan the screen made of phosphor 4 so as to reproduce the image.

Although the present invention is effective for the color cathode ray tube with a deflection angle of 90°, it is more effective when it is applied to a color cathode ray tube with a deflection angle of, for example, 100° or 110°. It is because that the larger the deflection angle, the problem on the increase of the deflection power becomes more important.

The present invention is effective for the color cathode ray tube having the neck portion whose outer diameter is 22.5 mm to 29.1 mm. In case the present invention is applied to the cathode ray tube having the neck portion whose outer diameter is not more than 25.3 mm, a further remarkable reduction of the deflection power can be realized. Further, it is preferable that the outer diameter of the neck portion is not more than 25.3 mm and the distance between electron beams is (electron beam distance: S) is set to not more than 5.0 mm, preferably not more than 4.75 mm. Such a constitution can minimize the danger that the electron beams impinge on the inner wall of the funnel portion in addition to the reduction of the deflection power.

The present invention is not limited to the color cathode ray tubes of the above-mentioned type or having the above-mentioned specification. The present invention is applicable to a so-called flat tube whose outer surface of a panel portion is a flat surface in the same manner as the color cathode ray tube whose outer surface of the panel portion is a curved surface.

What is claimed is:

1. A color cathode ray tube including a vacuum envelope comprised of a panel portion having an approximately rectangular shape and which has a phosphor film of three colors on an inner surface thereof, a neck portion which accommodates an inline type electron gun, and a funnel portion which connects said panel portion and said neck portion and has a deflection yoke mounting region at a transition region between said funnel portion and said neck portion;

wherein the shape of an outer wall opening and the shape of an inner wall opening in a direction perpendicular to the tube axis within a range which extends 35 mm to the panel portion side and 20 mm to the neck portion side from a reference line set in said deflection yoke mounting region of the funnel portion are respectively formed in an approximately rectangular shape and an approximately pin-cushion shape, the shape of the inner wall opening of said funnel portion in a direction perpendicular to the tube axis of the deflection yoke mounting region has a curvature which is indented toward the tube axis at respective corners, and the distance between a first straight line which connects neighboring bottom portions of said corner portions and a second straight line which is in contact with a central point of the inner wall between said neighboring corner portions and is disposed parallel to said first straight line is set to 2.0 mm at maximum, provided that the direction toward the tube axis is taken as +.

2. A color cathode ray tube including a vacuum envelope comprised of a panel portion having an approximately rectangular shape and which has a phosphor film of three colors on an inner surface thereof, a neck portion which accommodates an inline type electron gun, and a funnel portion which connects said panel portion and said neck portion and has a deflection yoke mounting region at a transition region between said funnel portion and said neck portion;

wherein the shape of an outer wall opening and the shape of an inner wall opening in a direction perpendicular to the tube axis at a reference line set in the deflection yoke mounting region of said funnel portion are respectively formed in an approximately rectangular shape and an approximately barrel shape, and in case a radius of curvature of an outer wall cross section is set to R1 (mm) and a radius of curvature-of an inner wall cross section in a direction corresponding to said radius of curvature R1 is set to R2 (mm), the relationship between said radii of curvature R1 and R2 are determined such that $R1 \geqq 100$ mm and $R2 \geqq R1$.

3. A color cathode ray tube according to claim 1, wherein an outer diameter of the neck portion which accommodates said inline type electron gun is not more than 25.3 mm.

4. A color cathode ray tube according to claim 2, wherein an outer diameter of the neck portion which accommodates said inline type electron gun is not more than 25.3 mm.

5. A color cathode ray tube according to claim 3, wherein the distance between electron beams at a main lens portion of said inline-type electron gun is not more than 5.0 mm.

6. A color cathode ray tube according to claim 5, wherein the distance between electron beams at a main lens portion of said inline-type electron gun is not more than 4.75 mm.

7. A color cathode ray tube according to claim 4, wherein the distance between electron beams at a main lens portion of said inline-type electron gun is not more than 5.0 mm.

8. A color cathode ray tube according to claim 7, wherein the distance between electron beams at a main lens portion of said inline-type electron gun is not more than 4.75 mm.

9. A color cathode ray tube according to claim 1, wherein the deflection angle of said color cathode ray tube is not less than 90°.

10. A color cathode ray tube according to claim 2, wherein the deflection angle of said color cathode ray tube is not less than 90°.

11. A color cathode ray tube including a vacuum envelope comprised of a panel portion having an approximately rectangular shape and which has a phosphor film of three colors on an inner surface thereof, a neck portion which accommodates an inline type electron gun, and a funnel portion which connects said panel portion and said neck portion and has a deflection yoke mounting region at a transition region between said funnel portion and said neck portion;

wherein the shape of an outer wall opening and the shape of an inner wall opening in a direction perpendicular to a tube axis within arrange which extends 35 mm to the panel portion side and 20 mm to the neck portion side from a reference line set in said deflection yoke mounting region of the funnel portion are respectively formed in an approximately rectangular shape and an approximately pin-cushion shape, the shape of the inner wall opening of said funnel portion in a direction perpendicular to the tube axis of the deflection yoke mounting region has a curvature which is indented toward the tube axis at respective corners, and the distance between a first straight line which connects neighboring bottom portions of said corner portions and a second straight line which is in contact with a central point of the inner wall between said neighboring corner portions and is disposed parallel to said first straight line is set to 1.0 mm at maximum, provided that the direction toward the tube axis is taken as +.

12. A color cathode ray tube according to claim 11, wherein the outer diameter of the neck portion which accommodates said inline type electron gun is not more than 25.3 mm.

13. A color cathode ray tube according to claim 11, wherein the distance between electron beams at a main lens portion of said inline-type electron gun is not more than 5.0 mm.

14. A color cathode ray tube according to claim 13, wherein the distance between electron beams at a main lens portion of said inline-type electron gun is not more than 4.75 mm.

15. A color cathode ray tube according to claim 11, wherein the deflection angle of said color cathode ray tube is not less than 90°.

16. A color cathode ray tube according to claim 15, wherein the deflection angle of said color cathode ray tube is not less than 100°.

17. A color cathode ray tube according to claim 1, wherein the funnel portion is configured so that an internal graphite film coating on the inner wall of the funnel portion in the deflection yoke mounting region is at least one of uniform film thickness, without occurrence of a liquid well, and without sagging of liquid, and enables a reduction in deflection power.

18. A color cathode ray tube according to claim 2, wherein the funnel portion is configured so that an internal graphite film coating on the inner wall of the funnel portion in the deflection yoke mounting region is at least one of uniform film thickness, without occurrence of a liquid well, and without sagging of liquid, and enables a reduction in deflection power.

19. A color cathode ray tube according to claim 11, wherein the funnel portion is configured so that an internal graphite film coating on the inner wall of the funnel portion in the deflection yoke mounting region is at least one of uniform film thickness, without occurrence of a liquid well, and without sagging of liquid, and enables a reduction in deflection power.

* * * * *